United States Patent [19]

Holleyman

[11] 4,162,614

[45] Jul. 31, 1979

[54] PRESSURE FLUID OPERATED POWER PLANT

[75] Inventor: John E. Holleyman, Monroe, La.

[73] Assignee: J.J.J. Air Injection Systems, Monroe, La.

[21] Appl. No.: 832,723

[22] Filed: Sep. 13, 1977

[51] Int. Cl.[2] ..... F15B 11/20; F15B 13/07

[52] U.S. Cl. ..... 60/370; 60/371; 60/407; 180/302

[58] Field of Search ..... 60/369, 370, 371, 407, 60/412; 91/247, 281, 304, 305; 180/66 B

[56] References Cited

U.S. PATENT DOCUMENTS

| | | | |
|---|---|---|---|
| 1,383,661 | 7/1921 | Raspotnik | 60/370 X |
| 3,885,387 | 5/1975 | Simington | 60/370 |
| 3,925,984 | 12/1975 | Holleyman | 60/370 |
| 4,018,050 | 4/1977 | Murphy | 60/370 |

*Primary Examiner*—Edgar W. Geoghegan
*Attorney, Agent, or Firm*—Raymond N. Matson

[57] ABSTRACT

A piston type power plant operable by any suitable pressure fluid available such as natural gas from a well for stationary applications, etc., or by compressed air in either stationary or mobile applications such as driving generators, saw mills or vehicles, etc., and embodying novel valve actuation and control means.

4 Claims, 9 Drawing Figures

FIG.1
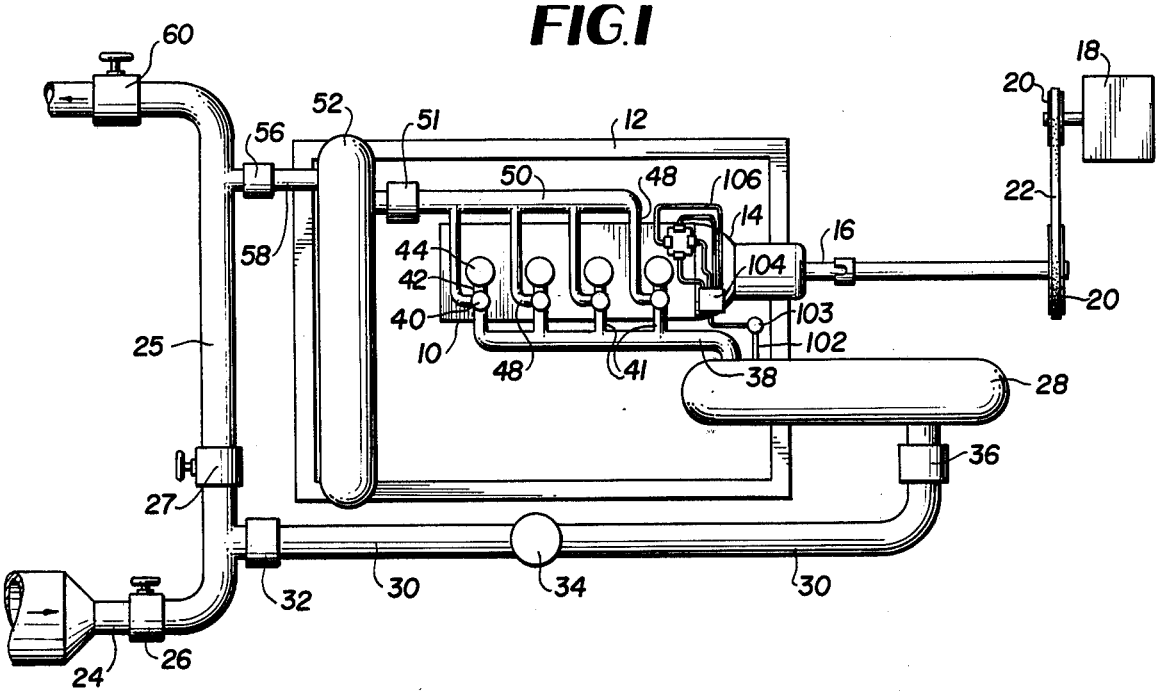
FIG.2
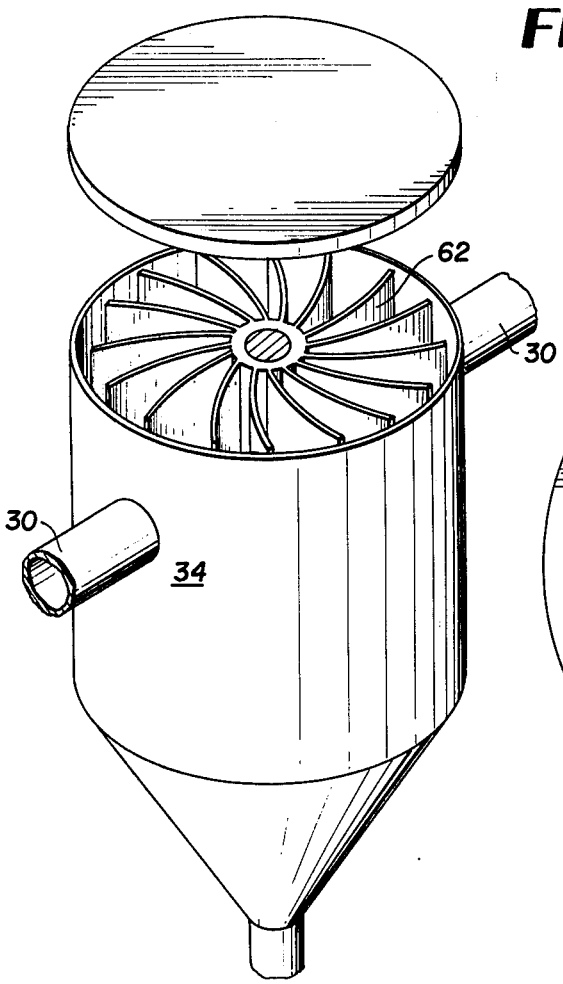
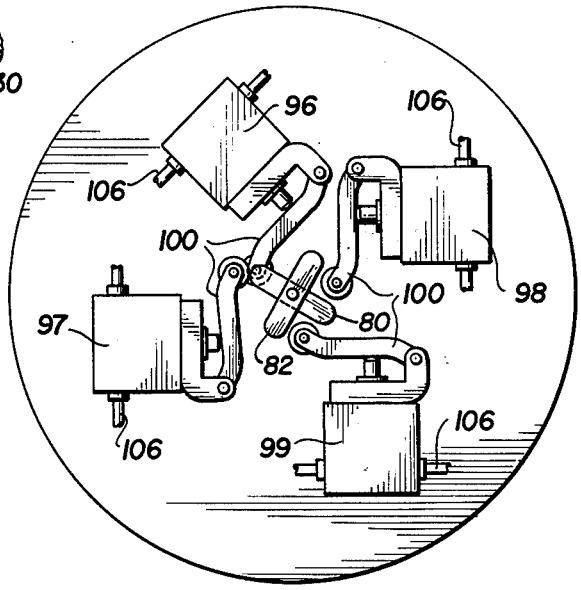
FIG.5

FIG. 7
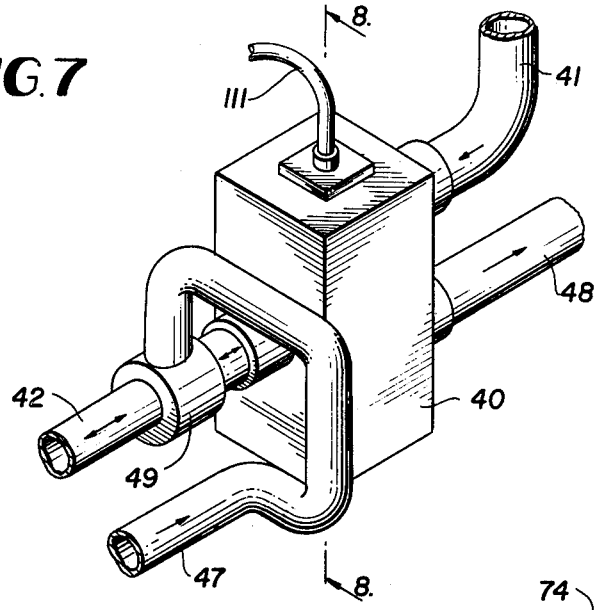
FIG. 8
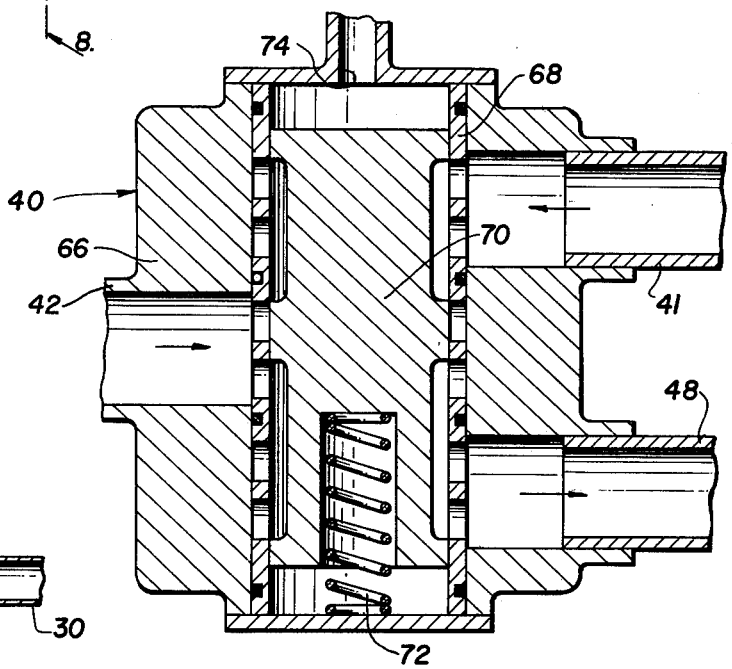
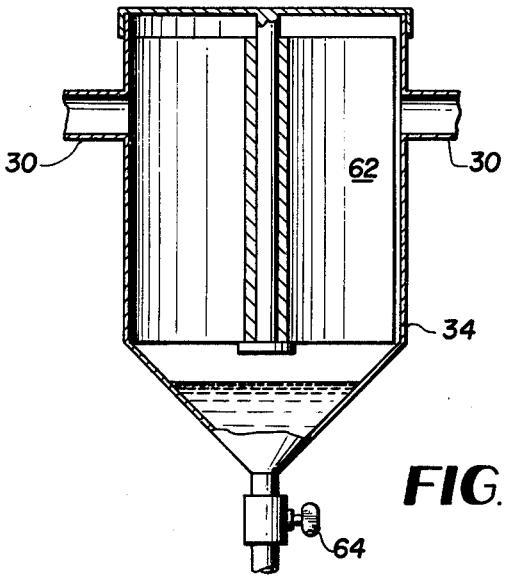
FIG. 3

PRESSURE FLUID OPERATED POWER PLANT

This invention relates generally to power plants and more particularly to a piston type engine which may be safely operated by any available pressure fluid and is an improvement on the power plant disclosed in my Pat. No. 3925,984 dated Dec. 16, 1975 in which solenoid valves and relay switches are successfully employed.

In order to render the power plant operable by any available pressure fluid of which some, as in the case of bore hole or natural gas pressure, are explosive, all potential spark making members must be eliminated.

Accordingly, the main object of the present invention is to provide an improved power plant which is so constructed as to be safely operated by any available pressure fluid whether explosive or not.

An important object of the present invention is to provide an improved piston type power plant which in stationary applications, may be operated by tapping natural gas pressure from wells or high pressure gas lines with the gas then being passed on for further conventional commercial and residential uses.

Another important object of the present invention is to provide an improved piston type power plant which may be powered by compressed air for stationary or mobile purposes.

A further important object of the present invention is to provide an improved piston type power plant which is operable by a pressure fluid which also operates the intake valves of the cylinders to eliminate any need for solenoid valves or relays.

A further important object of the present invention is to provide an improved power plant operated by a pressure fluid in which the energy of reciprocating pistons is converted to the rotative energy of a drive shaft to do useful work.

Other objects and advantages of the invention will become apparent during the course of the following description.

In the drawings I have shown one embodiment of the invention. In this showing:

FIG. 1 is a schematic top plan view of the pressure fluid operated power plant comprising the present invention;

FIG. 2 is a perspective view of an oil separator which is placed in the incoming pressure fluid pipe;

FIG. 3 is a central vertical schematic sectional view of the oil separator;

FIG. 5 is a top plan diagrammatic view to an enlarged scale of the valve actuating mechanism;

FIG. 7 is a perspective view to an enlarged scale of the spool valve which functions as an inlet and exhaust valve and the inlet and exhaust lines to and from the cylinders;

FIG. 8 is a central vertical sectional view to a further enlarged scale of the spool valve in the exhaust position.

Figure 4:
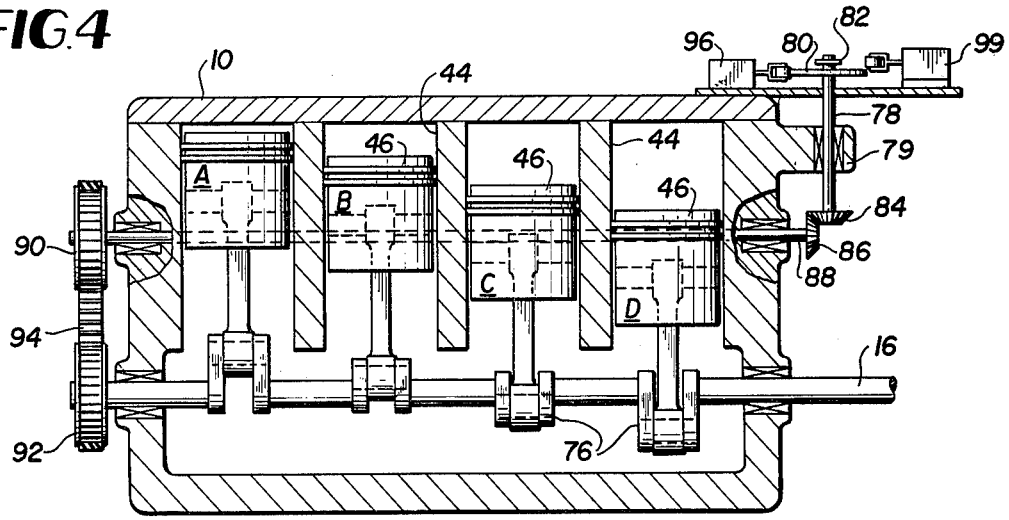
FIG. 4 is a vertical sectional view of a piston type engine showing the timing and valve means for the pressure fluid activated intake valve means.

Referring to the drawings, numeral 10 designates the pressure fluid operated piston type engine which is suitably mounted on a frame 12 and includes a transmission 14 and a drive shaft 16 which may be connected to a generator, sawmill, etc. 18 by a suitable means such as gears or pulleys 20 and drive chains or belts 22.

Pressure fluid such as that from a gas well, etc. (not shown) is conducted by a pipe 24 having an on-off value 26 to a pressure tank 28 by a pipe 30 having an adjustable pressure regulator 32 and an oil separator 34 in the event oil is mixed with the gas. The pipe 24 also connects with a bypass pipe 25 having a cut-off valve 27. The pressure tank 28 is employed to avoid pressure fluctuations and is provided with a check valve 36. The pressure fluid passes from the tank 28 through the inlet manifold 38 to spool valves 40 connected by a pipe 42 to each of the motor cylinders 44 and is exhausted by movement of the pistons 46 in the cylinders through pipes 48, exhaust manifold 50, and check valve 51 to an exhaust tank 52 which stabilizes the pressure of the exhaust. The gases then pass through a check valve 56 in exahust gas line 58 to an off-on valve 60 where it passes on for normal use in commerical and residential applications.

The oil separator 34 (FIGS. 2 and 3) includes vertically mounted arcuate fins 62 which are rotatable by the gas pressure so that any oil present is separated from the gas and falls to the bottom of the separator from where it is removed by a drain valve 64. Thus, oil free gas passes to the pressure tank 28 through the pipe 30 at 250 pounds per square inch and up as desired.

As seen in FIGS. 1, 6, 7 and 8, the spool valves 40 each comprise a housing 66 having an apertured sleeve 68 for passage of inlet or exhaust gases dependent on the position of the spool 70 which is maintained in the exhaust position shown in FIG. 8 by means of a compression spring 72. The spool is moved downwardly against the action of the spring to admit gas pressure by means of the spool, actuating gas pressure being directed against the top of the spool 70 through the aperture 74 from an actuating valve as will be described.

It is to be noted (FIG. 7) that the one half inch diameter inlet pipe 41 from the inlet manifold 38 furnishes gas pressure to the one half inch diameter pipe 42 and its cylinder 44 only when the spool 70 has been moved by actuating gas pressure introduced through aperture 74 lowering spool 70 to its bottom position against the spring 72. When the actuating pressure is cut off, the spool returns to the exhaust position shown in FIG. 8 whereupon the gas pressure from the cylinder 44 is exhausted through pipe 42, one half inch diameter pipe 47, junction 49, the spool valve 40, and one inch diameter exhaust pipe 48 to the exhaust manifold 50. The larger exhaust pipe 48 and junction 49 allows the engine to run free without back pressure buildup.

As seen in FIG. 4, as the gas pressure admitted to the cylinders 44 reciprocates the pistons 46 to rotate the drive shaft 16 by means of their cranks 76, the timing mechanism is actuated. This comprises a vertical cam shaft 78 having a pair of horizontally disposed cams 80, 82 fixed thereto at right angles to each other with cam 82 being positioned just above the cam 80. The cam shaft 78 is suitably mounted in bearings 79 and a gear 84 is fixed to the lower end thereof and is driven by a gear 86 fixed to the right end of a suitably journalled horizontal cam shaft 88. This latter is driven by a gear 90 driven by drive shaft gear 92 by means of a chain 94.

Figure 6:
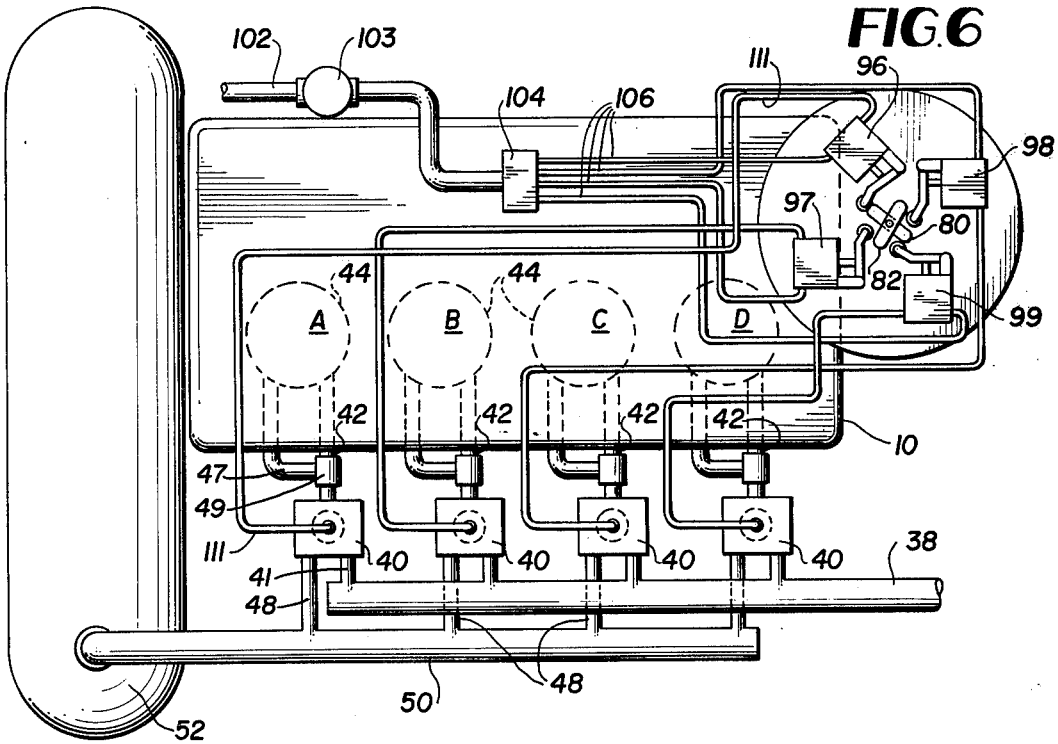
FIG. 6 is a top plan schematic view of the pressure fluid lines to the timing and valve actuating means including the inlet and exhaust manifolds.

As seen in FIGS. 4, 5 and 6, the timing mechanism of the present invention provides an actuating valve 96, 97, 98, 99 for the cylinders A, B, C, and D, respectively and each actuating valve has a spring-returned actuating arm 100 which is cyclically depressed by the cams 80 and 82 to direct pressure gas to the spool 40 of the cylinder in question, two of the arms 100 being positioned lower than the other two for proper engagement by the cams.

Referring to FIG. 6, pressure fluid is conducted from the pressure tank 28 by pipe 102 through a pressure regulator 103 set at 50 lbs./sq. in. to distributor 104 from where it is distributed to the actuating valves 96, 97, 98 and 99 through pipes 106.

As seen in FIG. 4, pressure fluid is admitted to the cylinders 44 against pistons 46 (A, B, C and D) sequentially and as shown, A is ready to begin its downward stroke, B and C are in intermediate positions, and D is at the bottom of its stroke and ready to begin it upward exhaust stroke.

In operation, cut-off valve 27 is closed and off-on valve 26 is opened to admit gas pressure to the pressure tank 28, inlet manifold 38, pipe 102, distributor 104, and pipes 106 to the actuating valves 96, 97, 98 and 99. At this time, the actuating arm of actuating valve 96 is depressed by cam 80 to admit pressure fluid to the line 111 which conducts it to the spool valve 40 of A where it passes through the aperture 74 (FIG. 8) to depress the spool 70 and admit pressure fluid from inlet line 41 to the cylinder 44 of piston A. Cam 82 then actuate valve 97, cam 80 operates valve 98, and cam 82 operates valve 99 in turn, the arms 100 of valves 97 and 99 being mounted higher for proper cam contact. As the cams 80, 82 rotate and engage the various actuating arms 100 in turn, the actuating valves 97, 98 and 99 actuated the spool valves 40 of the pistons B, C and D. As earlier stated, the pressure fluid, after the working stroke, is exhausted through pipes 42, 47, junction 49, spool valve 40, and pipe 48 to the exhaust manifold 50 and is discharged through exhaust tank 52 and pipes 58 and 25 for conventional commercial and residential use.

Figure 9:
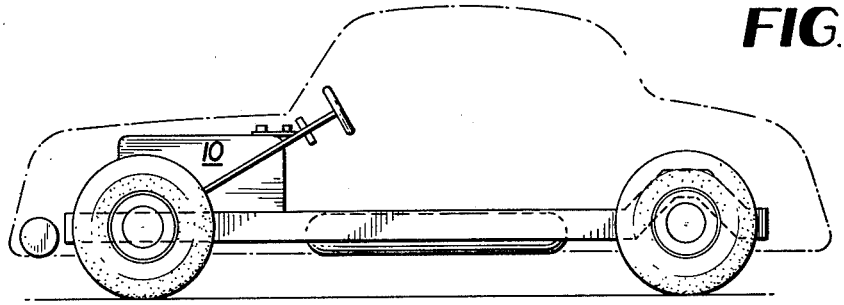
FIG. 9 is a schematic view of a vehicle operated by the present invention using compressed air.

When the power plant 10 comprising the present invention is in mobile applications such as vehicles, aircraft, boats, etc. (FIG. 9), the pressure fluid employed is compressed air. This is applied as shown and described in my U.S. Pat. No. 3,925,984 by battery power, compressors, etc. and is modified as described herein by the novel timing and valve actuation mechanism.

It is to be understood that the form of my invention herewith shown and described is to be taken as a preferred example of the same and that various changes in the shape, size and arrangement of parts may be resorted to without departure from the spirit of the invention or the scope of the subjoined claims.

What is claimed is:

1. A power plant adapted to have its pistons and its valves operated by a pressure fluid comprising, in combination; a piston and cylinder type engine having a drive shaft rotatable by the reciprocating pistons; and inlet manifold connected to a source of pressure fluid and an exhaust manifold; a unitary inlet and exhaust valve means positioned between and connected to each cylinder and said manifolds; timing means including a pressure fluid distributor connected to each of said unitary valve means for admitting pressure fluid thereto to move it cyclically to inlet position for admitting pressure fluid to said cylinders to reciprocate said pistons; and spring means for returning each of said unitary valve means to exhaust position upon the completion of each of said piston's working stroke.

2. The combination recited in claim 1 wherein said timing means includes an actuating valve connected to each line of said distributor and to each of said valve means; and rotary cam means for sequentially operating said actuating valves.

3. The combination recited in claim 1 wherein said unitary valve means comprise spools, and said spring means act against said spools.

4. The combination recited in claim 2 wherein said unitary valve means comprise spools, and said spring means act against said spools.

* * * * *